United States Patent [19]

Traiteur et al.

[11] Patent Number: 4,724,799

[45] Date of Patent: Feb. 16, 1988

[54] STEAM GENERATOR IN WHICH THE HEAT-CARRYING FLUID IS A LIQUID METAL AND THE DETECTION OF LEAKAGES IS CARRIED OUT BY SAMPLING THIS LIQUID METAL

[75] Inventors: René Traiteur, Ris-Orangis; Jean-Pierre Fabregue, Athis-Mons; Jean-Luc Minguet, St Aubin, all of France

[73] Assignee: Novatome, Le Plessis-Robinson, France

[21] Appl. No.: 822,565

[22] Filed: Jan. 27, 1986

[30] Foreign Application Priority Data

Jan. 25, 1985 [FR] France ..... 85 01070

[51] Int. Cl.[4] ..... F22B 37/42; G01M 3/00; F28D 7/00

[52] U.S. Cl. ..... 122/504; 122/34; 165/11.1; 165/70; 165/134.1; 73/40; 73/40.7

[58] Field of Search ..... 122/504, 32, 33, 34; 165/70, 158, 11.1; 73/23, 40, 40.7

[56] References Cited

U.S. PATENT DOCUMENTS

| | | | |
|---|---|---|---|
| 2,658,728 | 11/1953 | Evans, Jr. | 165/70 |
| 3,975,943 | 8/1976 | Brachet | 165/11.1 |
| 4,090,554 | 5/1978 | Dickinson | 165/11.1 |
| 4,140,176 | 2/1979 | Essebaggers | 165/70 |
| 4,368,694 | 1/1983 | Wand et al. | 122/504 |
| 4,418,748 | 12/1983 | Pouderoux et al. | 122/32 |

*Primary Examiner*—Henry C. Yuen

*Attorney, Agent, or Firm*—Pollock, Vande Sande & Priddy

[57] ABSTRACT

A steam generator in which the heat-carrying fluid is a liquid metal and the detection of leakages is carried out by sampling the liquid metal. The end of the steam generator through which the liquid metal enters comprises a tube plate (2), a thermal protection plate (10) and a hollow flow sill (22) constituting the end part of the bundle case (4). Tubes (20) for protecting the tubes (3) of the bundle are placed around each of the tubes (3) between the protection plate (10) and the tube plate (2), the space (17) between these two plates being closed on its periphery by a sleeve (15). The hollow sill (22) communicates with the space (17) through tubes (27) and with the inner volume or the bundle case (4). A liquid metal take-off device (31, 32) is placed in the hollow sill (22). The invention applies in particular to steam generators of fast neutron nuclear reactors cooled with liquid sodium.

11 Claims, 6 Drawing Figures

2
A
7

17
20
18
15
3'
13'
10
16
B
B
13'
27
13
13''
30
25
33
32
3
22
31
1
13'
35
24
13
30
12
23
13'
13
4

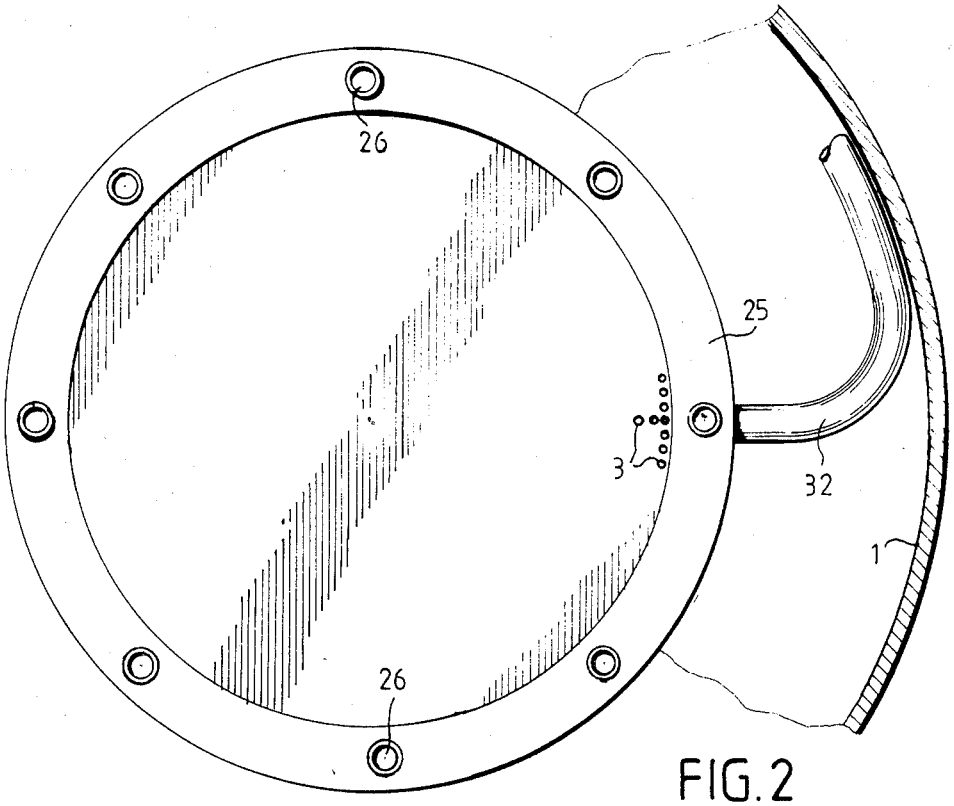
FIG. 2
FIG. 4
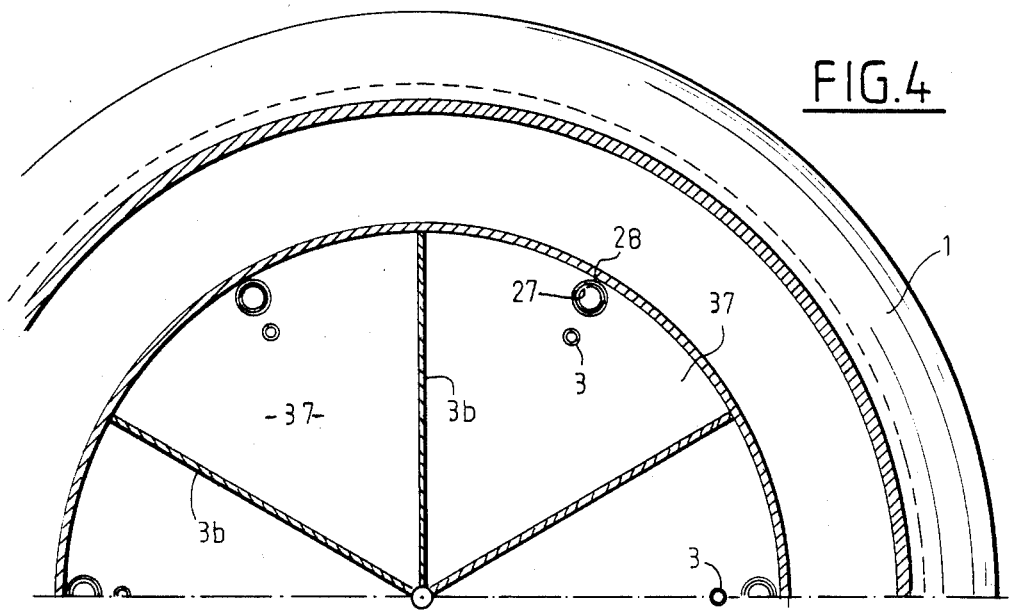

STEAM GENERATOR IN WHICH THE HEAT-CARRYING FLUID IS A LIQUID METAL AND THE DETECTION OF LEAKAGES IS CARRIED OUT BY SAMPLING THIS LIQUID METAL

FIELD OF THE INVENTION

The invention relates to a steam generator in which the heat-carrying fluid is a liquid metal and the detection of leakage is carried out by sampling this liquid metal.

BACKGROUND OF THE INVENTION

Steam generators of fast neutron nuclear reactors often employ a liquid metal, such as sodium, as the heat-carrying fluid for the heating and the vaporization of the feed water by means of the heat taken from the core of the reactor.

These steam generators are often constituted by an outer casing having a generally cylindrical shape disposed with its axis vertical and connected at each of its ends to a thick tube plate. The exchange part of the steam generator is formed by a bundle of tubes placed in the outer casing inside a bundle case coaxial therewith. Each of the tubes of the bundle is connected by welding at one of its ends to the lower tube plate and at its other end to the upper tube plate in the extension of a corresponding bore respectively passing through the lower tube plate and the upper tube plate. The lower tube plate separates the inner volume of the casing from a water box permitting the distribution of the feed water in the tubes of the bundle. The upper tube plate separates the inner volume of the casing from a steam manifold receiving the steam formed in each of the tubes of the bundle.

The heat-carrying liquid metal enters the inner volume of the casing in its upper part, i.e., a little below the upper tube plate. The bundle casing has its upper end located at a certain distance below the upper tube plate so that the liquid metal enters the bundle casing above the upper end of this bundle case. In order to achieve a distribution which is as homogeneous as possible of the sodium along the tubes of the bundle, the upper part of the bundle casing constitutes a flow sill having a generally hollow rounded shape.

In order to avoid a direct contact between the lower side of the upper tube plate and the hot liquid metal entering the casing of the steam generator, there is often disposed, parallel to the tube plate and a little below the latter, a thermal protection plate which is thinner than the tube plate. The tubes of the bundle extend through the thermal protection plate in openings machined in the latter and are welded at their upper end to hollow spigots machined in the tube plate.

Between the thermal protection plate and the upper tube plate, the tubes of the bundle are surrounded over a part of their length by protection tubes having an inside diameter which is such that there is a radial clearance between the tube of the bundle and the corresponding protection tube. The radial space between the tube of the bundle and the protection tube opens, at one of its ends, onto the inner space of the steam generator below the thermal protection plate and, at its other end, onto the space between the thermal protection plate and the upper tube plate.

It is extremely important to detect very rapidly any possible leakage of feed water or steam in the heat-carrying liquid metal. Indeed, in the case of sodium, for example, a leakage of water or steam whose pressure is higher than that of the sodium may result in a very violent chemical reaction accompanied by a shock wave in the inner volume of the steam generator. It is possible to reduce or eliminate the disastrous effect of such a leakage if its detection is sufficiently rapid to permit the taking of the desired safety measures before an appreciable amount of water or steam has entered the liquid metal.

Such leakages have a much higher probability of occurring in the zones of the welding of the tubes to the tube plates, at their ends, than in the other zones of the tube. More precisely, the leakages often occur in the region of the weld between the upper end of the tube and the upper tube plate, this end of the tube being in contact with a liquid sodium which is much hotter than the lower end.

Devices for sampling liquid sodium have therefore been proposed for purposes of detecting and measuring the amount of hydrogen in the sampled sodium disposed in the vicinity of the upper end of the steam generator. However, these samples, which permit the detection of the presence of hydrogen revealing a leakage of water in the liquid sodium, are taken in a zone in which the hot sodium entering the steam generator arrives, so that they do not really concern a flow of sodium which has circulated in contact with the zone of the welding of the tubes and is consequently highly charged with hydrogen in the event of a leakage in one of the tubes.

The detection is therefore uncertain and depends on the rapidity with which the hydrogen spreads in the liquid sodium circulating in its upper part.

SUMMARY OF THE INVENTION

An object of the invention is therefore to provide a steam generator whose heat-carrying fluid is a liquid metal and in which there is a detection of possible leakage by sampling this liquid metal, comprising an outer casing having a generally cylindrical shape connected at each of its ends to a very thick tube plate, a bundle of tubes disposed within a bundle casing coaxial with the outer casing and placed inside the latter, having one of its ends, or inlet end, for the heat-carrying fluid located at a certain distance from the corresponding tube plate, at least one opening for the supply of the hot liquid metal extending through the outer casing in the vicinity of the inlet end of the bundle casing which constitutes a flow sill which has a rounded and hollow shape and over which the liquid metal passes so as to enter the bundle casing, each of the tubes of the bundle being welded at one of its ends to one of the tube plates and at its other end to the other tube plate, in the region of a bore extending through the tube plate, a thermal protection plate disposed to be parallel to the corresponding tube plate at the inlet end of the heat-carrying fluid and between this tube plate and the end of the bundle casing, protection tubes each surrounding a tube of the bundle with a certain radial clearance, between the thermal protection plate and the corresponding tube plate, so that the radial space provided between the two tubes opens, at one of its ends, onto the side of the protection plate facing the interior of the steam generator, and at its other end, in the space between the tube plate and the corresponding thermal protection plate, this steam generator permitting the rapid and reliable detection of a leakage of water or steam at one of the ends of the tubes of the bundle without requiring a marked modification of the structure of the steam generator.

For this purpose, adjacent to the inlet end of the steam generator:

(a) the space between the tube plate and the thermal protection plate is closed at its periphery by a sleeve coaxial with the outer casing and the bundle casing;

(b) the inner volume of the hollow flow sill communicates, at one of its ends, with the inner volume of the bundle casing and, at its other end, with the space between the tube plate and the thermal protection plate through substantially vertical tubes, so that the liquid metal circulates from the interior of the steam generator, first of all toward the space between the thermal protection plate and the tube plate, in the protection tubes, and then toward the flow sill in the vertical tubes; and (c) means for sampling liquid metal are disposed in the volume of the flow sill.

BRIEF DESCRIPTION OF THE DRAWINGS

In order to explain the invention, there will now be described by way of non-limiting examples, with reference to the accompanying drawings, two embodiments of a steam generator in which the heat-carrying fluid is liquid sodium and which permits the detection of a leakage by a sampling of the liquid sodium in the steam generator.

FIG. 2 is a view along line B—B of FIG. 1.

FIG. 4 is a view taken along line C—C of FIG. 3.

FIG. 1 shows the upper part of a steam generator comprising an outer casing 1 having a generally cylindrical shape and connected to an end portion in the shape of a spherical sector which is welded to a very thick tube plate 2. A bundle casing 4 of cylindrical shape is disposed inside the outer casing 1 and coaxially with the latter. The bundle is formed by a large number of straight tubes 3 the upper part of which is connected by welding to the tube plate 2 and is shown in FIG. 1*a*. The latter shows the upper end of the tube 3 connected by a weld 6 to a spigot 5 machined on the lower side of the tube plate 2. The tube plate 2 has a bore 7 in the extension of the inner bore of the tube 3 which therefore communictes with the steam manifold 9 located above the tube plate 2. Only one tube is shown in FIG. 1*a*, but it will be clear that the tube plate has a very large number of spigots, such as 5, for the connection of all of the tubes of the bundle to straight tubes of the steam generator. FIG. 1 shows the axes 3' of an assembly of tubes 3 of the bundle.

Each of the tubes 3 is connected in its lower part (not shown in FIGS. 1 and 1*a*) to the lower tube plate of the steam generator connected to the lower part of the outer casing 1. The ends of the tube are connected to the lower tube plate and to the upper tube plate by welding to a spigot provided on the upper side of the lower tube plate and on the lower side of the upper tube plate respectively.

Figure 1:
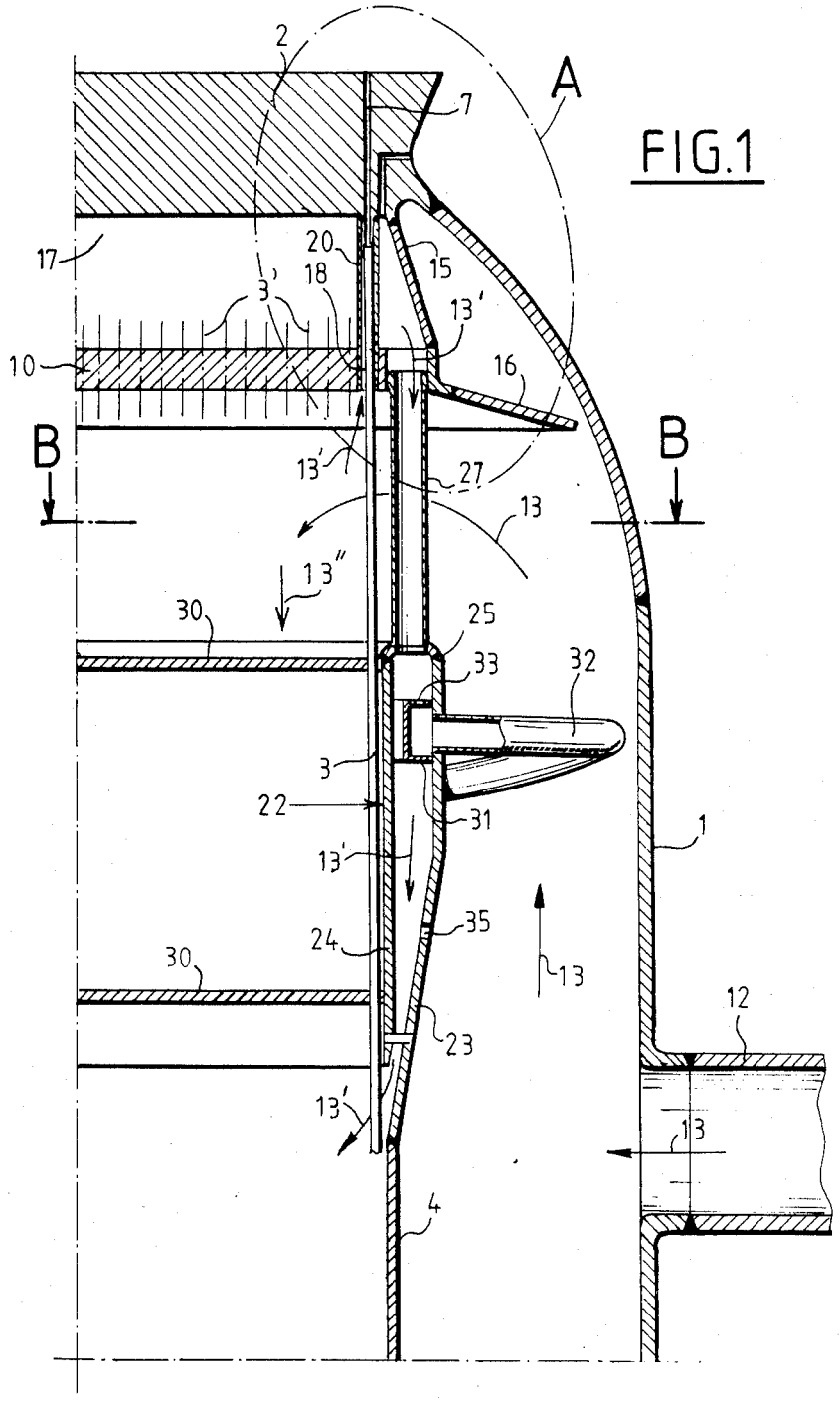
FIG. 1 is a semi-sectional view in a vertical plane of the upper part of a steam generator according to the invention.

FIG. 1 shows a pipe 12 fixed to the outer casing 1 of the steam generator for the introduction of hot liquid sodium to the interior of the steam generator. A thermal protection plate 10, parallel to the tube plate 2 and much thinner than the plate 2, is disposed a certain distance below the latter. This plate 10 prevents the hot liquid sodium entering through the pipe 12 and circulating in the direction of arrows 13 from coming into direct contact with the thick tube plate 2, which is very sensitive to thermal shocks. The thermal protection plate 10 is fixed under the tube plate 2 by a frusto-conical sleeve 15 entirely closing the periphery of the space 17 between the plates 2 and 10. A sleeve 16 for deflecting the liquid sodium is also fixed to the lower outer edge of the thermal protection plate 10.

The thermal protection plate 10 is provided with a very large number of bores 18 having a diameter substantially greater than the diameter of the tubes 3 on the axes 3' of these tubes of the bundle.

Placed around each of the tubes 3 is a protective sleeve 20 whose inside diameter is such that there is a relatively large radial clearance between the tube 3 and the sleeve 20. Each of the sleeves 20 is fixed to the interior of a bore 18 and welded in its lower part to the protection plate 10. The sleeve 20 has sufficient length to ensure that the zone 6 of the welding of the tube 3 to the tube plate 2 is located inside the sleeve.

The upper part of the bundle casing 4 constitutes a hollow sill generally designated by the reference numeral 22. This hollow sill is formed by a cylindro-conical sleeve 23 welded to the upper part of the cylindrical bundle casing 4, a cylindrical inner sleeve 24 and an annular and rounded upper closing part 25 shown in FIGS. 1 and 2. A space of small transverse extent is provided between the sleeve 23 and 24 in their lower part so as to put the inner volume of the sill 22 in communication with the inner space of the bundle casing 4.

The upper part of the bundle casing 4 formed by the flow sill 22 guides the hot sodium stream circulating in the direction of arrows 13 and distributes it in a homogeneous manner in the bundle at the moment at which it flows over the rounded part 25 of the flow sill. This part 25 includes openings 26 spaced apart from each other with a constant angular spacing throughout its circumference. Fixed in each of the openings 26 is the lower end of a vertical tube 27 whose upper end is engaged in an opening 28 extending through the thermal protection plate 10 adjacent to its periphery.

Figure 1A:
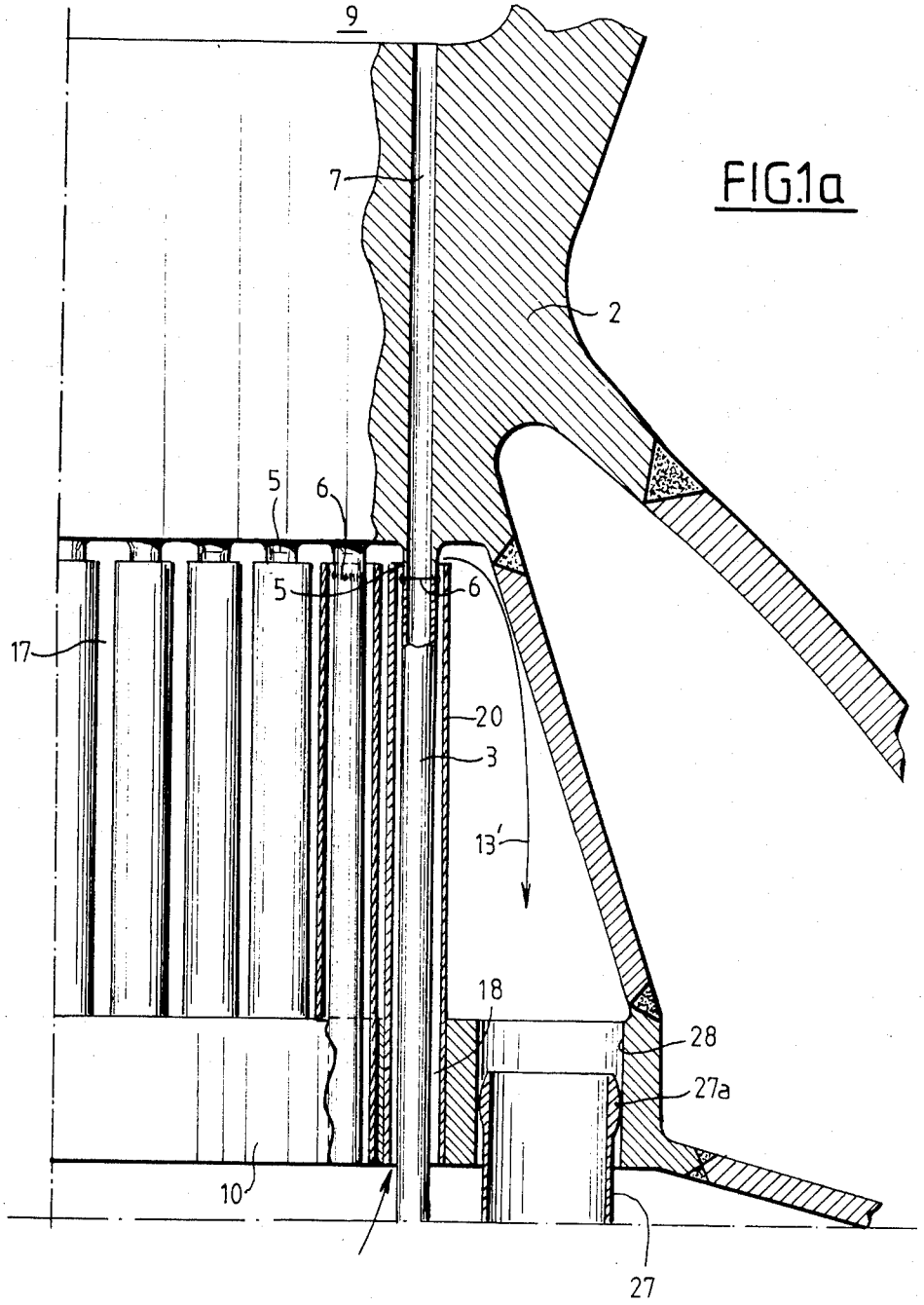
FIG. 1*a* is an enlarged view of the detail A of FIG. 1.

FIG. 1*a* shows that the end of the tube 27 is machined so as to form a spherical bearing portion 27*a* permitting its centering inside the opening 28 of the protection plate.

Fixed on the inner cylindrical sleeve 24 of the hollow sill 22 are support and spacer devices 30 for the tubes 3 of the bundle evenly spaced apart in the axial direction of the steam generator. These supporting and spacer devices 30 result in a pressure drop in the descending circulation of the liquid sodium (arrow 13''). The pressure is therefore lower in the lower part of the hollow sill 22 than under the tube plate 11 and there is consequently produced a circulation of sodium in the direction indicated by the arrows 13' in FIGS. 1 and 1*a*. A part of the sodium passing above the flow sill 22 is directed upwardly inside the radial space between the tube 3 and its sleeve 20, this radial space opening out in its lower part below the thermal protection plate 10 and in its upper part in the space defined by the thermal protection plate 10 and the upper tube plate 2. The upward flow of the liquid sodium therefore passes alongside the zone of the weld 6 between the tube 3 and the tube plate 2 before the liquid sodium descends into the space between the thermal protection plate 10 and the tube plate 2 to the upper end of the tubes 27. The sodium then descends through the tubes 27 in the inner volume of the hollow sill 22 from which the sodium is aspirated by the pressure difference toward the inner space of the bundle where it is mixed with the main descending stream 13" in the bundle.

A sampling or take-off means recovers a part of the sodium flowing in the direction indicated by the arrows 13' so as to send it to a hydrogen detecting and measuring device. This sampling means is formed by a ring-shaped casing 31 having a rectangular section including openings 33 in its upper wall disposed inside the hollow sill 22, and by a take-off or sampling conduit 32, shown in FIGS. 1 and 2, which conducts this taken-off sodium to the exterior of the outer casing 1 of the steam generator to the hydrogen detecting and measuring device. The flow of sodium in the path represented by the arrows 13' comes in contact with the zone of the weld 6 between the tube and the tube plate and, in the event of a leakage of steam in the vicinity of this zone, the flow of sodium is very rapidly and highly contaminated by hydrogen. This sodium taken off or sampled by the device 31, 32 is directly conducted to the detecting and measuring device without undergoing a mixing with the sodium entering the steam generator. The detection is therefore very sensitive and very rapid.

The temperature of the sodium flowing in the path shown by the arrows 13' undergoes an evolution which is different from that of the main stream of sodium in the axial descending path shown by the arrows 13". The sodium issuing from the lower part of the sill 22 is usually colder than the sodium flowing in the bundle. In order to limit or eliminate this temperature difference, apertures 35 are provided in the lower part of the sill below the ring-shaped take-off device 31. Hot sodium entering in the path 13 is mixed with the sodium issuing from the lower part of the sill by passing into the latter through the apertures 35. This re-introduction of hot sodium enables the temperature of the stream 13' to be balanced relative to the temperature of the main stream 13". This re-introduction of sodium below the take-off ring therefore does not result in a dilution of the sodium taken off with the entering hot sodium.

Figure 3:
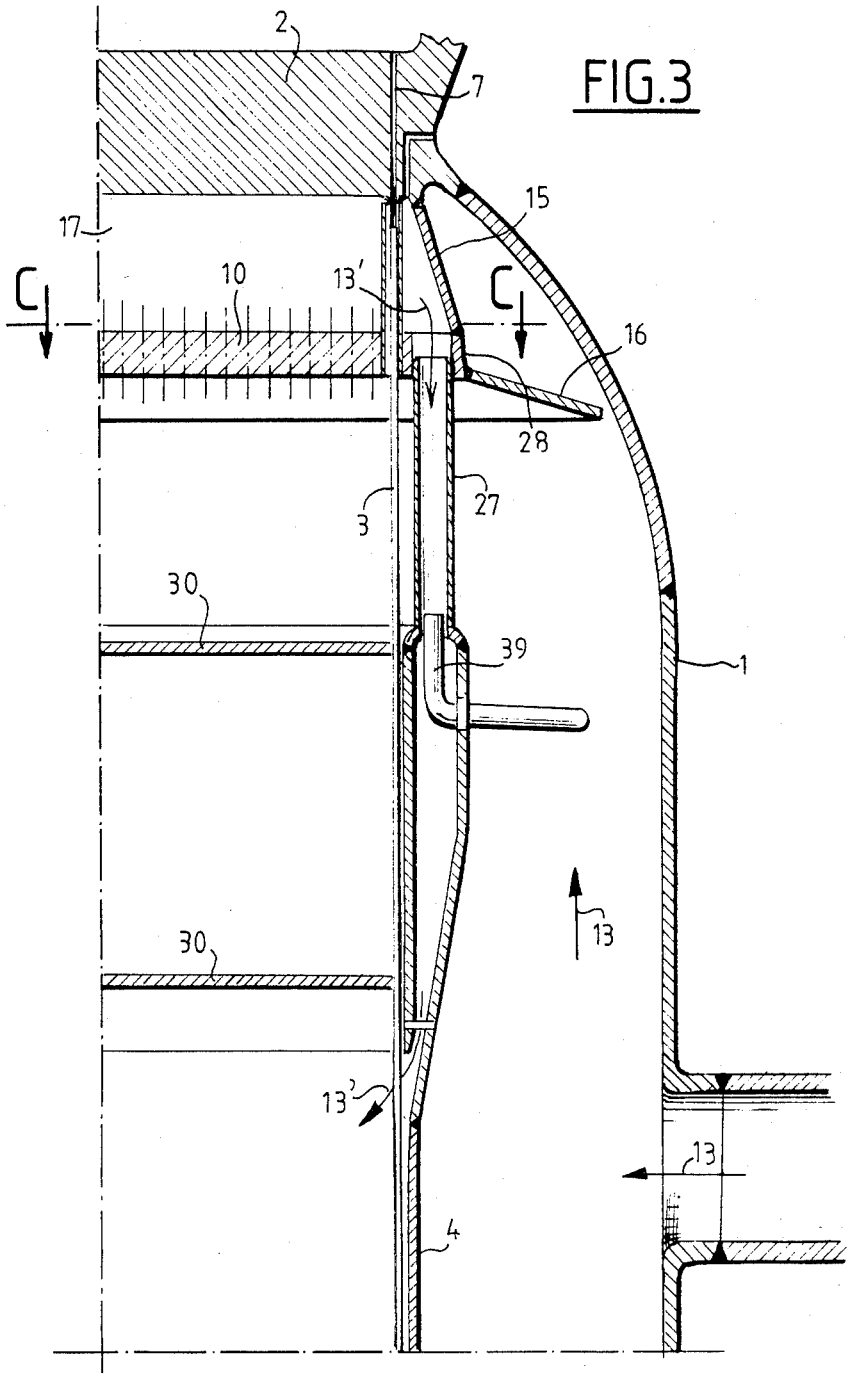
FIG. 3 is a sectional view taken in the vertical plane of the upper part of a second embodiment of the steam generator according to the invention.
Figure 5:
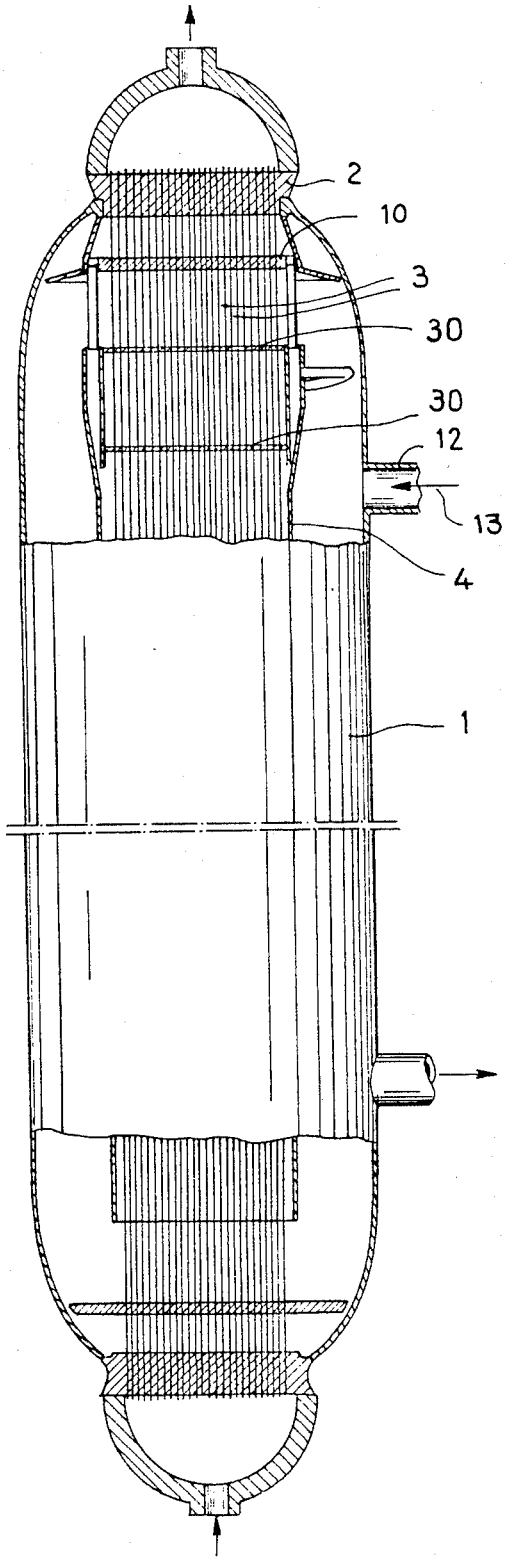
FIG. 5 is a vertical elevation in full section of the steam generator.

FIGS. 3 and 4 show a modification of the upper part of the steam generator, the corresponding elements in FIGS. 3 and 4, on one hand, and 1 and 2, on the other hand, carrying the same reference characters.

In the modification shown in FIGS. 3 and 4, the space 17 between the protection plate 10 and the tube plate 2 is divided into six distinct parts 37 by vertical and radial partition walls 36 which are substantially fluid-tight and disposed angularly at 60° to each other. Associated with each of the parts 37 of the space 17 is a vertical tube 27 disposed inside an opening 28 extending through the tube plate 10. The tube 27 conducts the flow of sodium 13' which has flowed in contact with the zone of the weld of the tube 3 into a take-off tube 39. The six tubes 39 each corresponding to a part 37 of the space 27 are connected independently to the hydrogen detecting and measuring device. This device permits, in the event of leakage in the zone of the weld of one of the tubes 3, distinguishing the conduit 39 which had conducted the flow of sodium polluted by the hydrogen, i.e., the part 27 in the shape of a sector in which the tube having a leakage is located. The individual taking-off by sectors therefore facilitates the searching of the leakage and the repairing of the steam generator.

The main advantages of the steam generator according to the invention as concerns the detection of leakage are clear from the foregoing description. This detection is effected on a relatively small flow of sodium and in which the concentration of hydrogen becomes immediately very high in the event of a leakage in the region of the weld zone of a tube 3. This sensitive and rapid detection of a leakage is achieved by a small modification of the upper part of the steam generator which does not substantially affect the main flow of sodium. The protection of the weld zone of the tubes and of the upper tube plate is at least equivalent if not superior to the protection achieved in steam generators of the prior art. Indeed, the weld zone 6 of the tube is located inside the protection sleeve 20, and the space 17 between the protection plate 10 and the tube plate 2 is completely closed on its periphery. The hot sodium entering the steam generator in the path 13 therefore never comes in direct contact with the weld zone of the tube and with the tube plate 2. The detection can permit a partial localization of the leakage by simply providing a partitioning of the upper space 17 of the steam generator above the protection plate 10.

The scope of the invention is not limited to the described embodiments. Thus, the sill may have a form different from that described, the take-off or sampling device may be constructed in a different manner and the vertical tubes connecting the inner volume of the sill to the upper space of the steam generator above the thermal protection plate may be rigidly fixed at one of their ends to this protection plate and slidably mounted at their other end in the sill, instead of the reverse arrangement described above. Any partitioning of the upper space 17 of the steam generator may be adopted for refining the localization of the leakages.

It will also be clear that the steam generator may have a take-off unit such as that described in its lower part, in the case where the lower end of the steam generator constitutes the inlet end of the heat-carrying fluid. In this case, the lower end of the bundle case constitutes its inlet end constructed in the form of a hollow and rounded sill. A thermal protection plate is disposed above the lower tube plate at a certain distance from the latter. In this way, it is assured that there is no direct contact of the hot sodium with the lower tube plate, this hot sodium being conducted in this embodiment through a pipe in the vicinity of the lower part of the steam generator. The arrangement of the elements permitting the taking off or sampling of the sodium which has flowed in the vicinity of the weld zone of the tubes of the bundle on the lower tube plate is moreover practically identical to the arrangement described above. Moreover, the invention may be applied to steam generators whose axis is not vertical.

The steam generators according to the invention may employ a heat-carrying fluid other than liquid sodium, and is constituted, for example, by the eutectic sodium-potassium mixture, or by lithium.

The generator may have straight tubes or helical tubes, the ends of these tubes being disposed to be parallel and vertical for welding to the tube plate.

What is claimed is:

1. A steam generator in which a heat-carrying fluid is a liquid metal and a detection of leakages is carried out by taking off a sample of said liquid metal, said generator comprising (a) two very thick tube plates;

(b) a generally cylindrical outer casing having a vertical axis and connected at ends of said outer casing to said very thick tube plates;

(c) a bundle casing coaxial with and disposed inside said outer casing;

(d) a bundle of tubes disposed inside said bundle casing, said bundle casing having an inlet end of said heat-carrying fluid located at a distance from a respective one of said tube plates;

(e) means defining at least one liquid metal inlet opening extending through said outer casing in the vicinity of said inlet end of said bundle casing which constitutes a flow sill which has a rounded and hollow shape and over which the liquid metal is adapted to pass so as to enter said bundle casing, each of the tubes of said bundle of tubes being welded at one end to one of said tube plates and at an opposite tube end to the other of said tube plates, in the region of a bore extending through said one tube plate;

(f) a thermal protection plate parallel to the corresponding tube plate at the heat-carrying fluid inlet end; and (g) protection tubes located between said tube plate and said bundle casing, said protection tubes each surrounding a respective tube of said bundle of tubes with a radial clearance, located between said thermal protection plate on which they are fixed and the corresponding tube plate, so that the radial space between the protective tube and bundle tube opens out at one end of said radial space onto a side of said protection plate facing toward the interior of the steam generator and, at an opposite end of said radial space, onto the space between said tube plate and the corresponding thermal protection plate; wherein, adjacent to the inlet end through which the heat-carrying fluid enters the steam generator:

(h) the space between said tube plate and said thermal protection plate is closed on the periphery thereof by a sleeve coaxial with said outer casing and said bundle casing;

(i) said hollow flow sill has an inner volume which communicates at one end with an inner volume of said bundle casing and at an opposite end with the space between said tube plate and said thermal protection plate through third substantially vertical tubes so that said liquid metal flows from the interior of the steam generator, first to the space between said thermal protection plate and said tube plate through said protection tubes, and then to said flow sill through said vertical tubes; and (j) means for taking off liquid metal disposed in the inner volume of said flow sill.

2. A steam generator according to claim 1, wherein said third vertical tubes are rigidly fixed at one end thereof to one of two elements consisting of said flow sill and said thermal protection plate and are slidably mounted at an opposite end thereof in an opening provided in the other of said two elements consisting of said protection plate and said flow sill, respectively.

3. A steam generator according to claim 1, wherein each of said protection tubes, fixed at one end thereof to said protection plate, has a length such that it surrounds, at an opposite end thereof, a zone of the weld between the respective tube of said bundle of tubes and said tube plate.

4. A steam generator according to claim 2, wherein each of said protection tubes, fixed at one end thereof to said protection plate, has a length such that it surrounds, at an opposite end thereof, a zone of the weld between the respective tube of said bundle of tubes and said tube plate.

5. A steam generator according to claim 1, wherein an upper space of the steam generator between said thermal protection plate and said tube plate is divided by substantially fluid-tight partition walls into a plurality of parts in each of which parts said thermal protection plate is provided with an opening in which is mounted one of said third substantially vertical tubes connecting the corresponding part of said space to the interior space of said sill in which sill, is mounted a take-off tube in a prolongation of the respective third vertical tube, the take-off tubes being connected, independently of each other, to a hydrogen detecting and measuring device.

6. A steam generator according to claim 2, wherein an upper space of the steam generator between said thermal protection plate and said tube plate is divided by substantially fluid-tight partition walls into a plurality of parts in each of which parts said thermal protection plate is provided with an opening in which is mounted one of said third substantially vertical tubes connecting the corresponding part of said space to the interior space of said sill, in which sill, is mounted a take-off tube in a prolongation of the respective third vertical tube, the take-off tubes being connected, independently of each other, to a hydrogen detecting and measuring device.

7. A steam generator according to claim 3, wherein an upper space of the steam generator between said thermal protection plate and said tube plate is divided by substantially fluid-tight partition walls into a plurality of parts in each of which parts said thermal protection plate is provided with an opening in which is mounted one of said third substantially vertical tubes connecting the corresponding part of said space to the interior space of said sill, in which sill, is mounted a take-off tube in a prolongation of the respective third vertical tube, the take-off tubes being connected, independently of each other, to a hydrogen detecting and measuring device.

8. A steam generator according to claim 1, wherein said hollow sill comprises, in a wall thereof facing toward the inlet of the hot liquid metal into the steam generator, orifices located below said take-off means.

9. A steam generator according to claim 2, wherein said hollow sill comprises, in a wall thereof facing toward the inlet of the hot liquid metal into the steam generator, orifices located below said take-off means.

10. A steam generator according to claim 3, wherein said hollow sill comprises, in a wall thereof facing toward the inlet of the hot liquid metal into the steam generator, orifices located below said take-off means.

11. A steam generator according to claim 4, wherein said hollow sill comprises, in a wall thereof facing toward the inlet of the hot liquid metal into the steam generator, orifices located below said take-off means.

* * * * *